United States Patent [19]

Vitaloni

[11] Patent Number: 4,689,836

[45] Date of Patent: Sep. 1, 1987

[54] HEADGEAR FOR MOTORCYCLING AND SIMILAR ACTIVITIES, WITH A MOVABLE VISOR AND CHIN GUARD

[75] Inventor: Alberto Vitaloni, Turin, Italy

[73] Assignee: Vitaloni Group S.p.A., Turin, Italy

[21] Appl. No.: 885,151

[22] Filed: Jul. 14, 1986

[30] Foreign Application Priority Data

Nov. 5, 1985 [IT] Italy ..... 54002/85[U]

[51] Int. Cl.[4] ..... A42B 1/08

[52] U.S. Cl. ..... 2/424; 2/425; 2/411; 2/8; 2/9

[58] Field of Search ..... 2/424, 410, 411, 412, 2/425, 9, 8

[56] References Cited

U.S. PATENT DOCUMENTS

| | | | |
|---|---|---|---|
| 3,095,575 | 7/1963 | Radov | 2/8 |
| 3,517,392 | 6/1970 | Hodge et al. | 2/8 |
| 4,024,587 | 5/1977 | Barford | 2/424 |
| 4,553,270 | 11/1985 | Hoffmann | 2/424 X |
| 4,598,430 | 7/1986 | Nava | 2/425 X |

FOREIGN PATENT DOCUMENTS

| | | | |
|---|---|---|---|
| 960002 | 12/1974 | Canada | 2/411 |
| 2846636 | 4/1980 | Fed. Rep. of Germany | 2/424 |
| 2462880 | 3/1981 | France | 2/424 |

*Primary Examiner*—Werner H. Schroeder
*Assistant Examiner*—J. L. Olds
*Attorney, Agent, or Firm*—Robbins & Laramie

[57] ABSTRACT

Headgear for motorcycling and like activities comprises a protective helmet, a visor and a chin guard. Both the visor and the chin-guard and substantially C-shaped in plan so as to have lateral arms which are fixed to the sides of the helmet by respective hinge means that allow the visor to be moved between a lowered position in front of the upper part of the face and a raised position on the forehead and the chin guard to be moved between a raised position in front of the lower part of the face and a lowered position beneath the chin. The arms of the visor and of the chin guard are interconnected in correspondence with their respective hinge means by operating means such that the lowering of one of the visor and chin guard causes the concomitant raising of the other and vice versa.

15 Claims, 13 Drawing Figures

Figure 2:
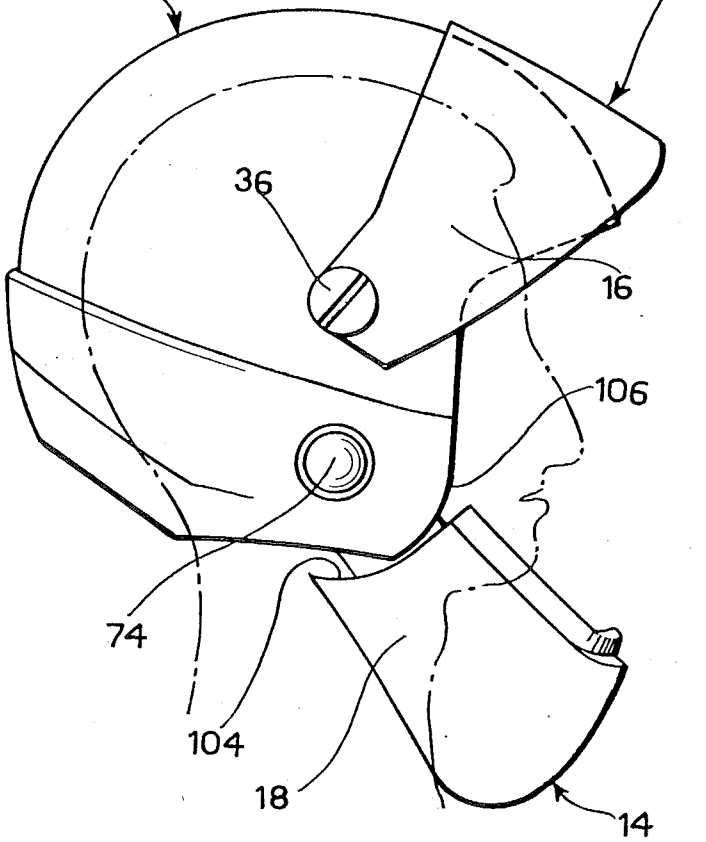

HEADGEAR FOR MOTORCYCLING AND SIMILAR ACTIVITIES, WITH A MOVABLE VISOR AND CHIN GUARD

The present invention relates to a protective headgear for motorcycling and like activities comprising a protective helmet, a visor and a chin guard both substantially C-shaped in plan so as to have lateral arms which are fixed to the sides of the helmet by respective hinge means which allow the visor to be moved between a lowered position in front of the upper part of the face and a raised position on the forehead and the chin guard to be moved between a raised position in front of the lower part of the face and a lowered position beneath the chin.

In motorcycling headgear the mobility of the visor is an almost essential pre-requisite. For some time headgear in which the chin guard is also movable have been in use. A movable chin guard has a considerable practical advantage since it allows the motorcyclist to eat or drink or to smoke a cigarette etc., without removing his helmet.

It is usual for a motorcyclist to raise the visor as well so as to uncover his face completely when he lowers the chin guard. It would in fact be rather disagreeable to eat a sandwich, drink a drink or to smoke a cigarette with the visor in front of one's eyes.

In certain known headgear the opening of the visor is achieved by pressure on push buttons located in the temporal zones of the headgear. Such so-called "automatic" systems for closing and opening the visor do not however involve the chin guard which is operated independently by gripping it with the hand from in front.

The movement of the visor by means of lateral push buttons enables one, among other things, not to touch it with the hands, thus avoiding soiling it. However the lateral buttons also have their disadvantages, that is a certain difficulty in locating them, particularly if the motorcyclist is wearing gloves.

The locating and operating difficulty does not however exist for the chin guard for which the problem of soiling is in any case negligible.

The object of the invention is to provide headgear having a movable chin guard and visor and a system which enables the visor and the chin guard to be manoeuvred easily and quickly without requiring the finding of lateral push buttons and preferably without the hands touching the visor.

According to the present invention, this object is achieved by means of headgear of the type defined in the introductory paragraph of the present specification, characterised in that operating means are connected to the respective hinge means for the arms of the visor and of the chin guard such that the lowering of the one causes the concomitant raising of the other and vice versa.

By virtue of this solution, in order to uncover the whole of the face it suffices to grasp the chin guard and to draw it downwardly, at the same time achieving the raising of the visor without touching it. In order to return the headgear to the closed configuration it suffices to push the chin guard upwardly. Naturally, there is nothing to stop one effecting this operation by grasping the visor in this case taking care not to soil it.

Preferably the operating means incorporate a friction connection such as to allow the visor and the chin guard to be moved independently.

This characteristic is useful when the wearer of the headgear wishes to keep the visor raised in order to have the wind in his face, or to have it partially closed for cooling purposes while however keeping the chin guard up for protection.

The lateral arms of the chin guard are also preferably fixed to the respective hinge means by releasable coupling means to allow the optional removal of the chin guard itself.

This characteristic is useful in sports such as motocross, which do not involve high risks of collision but, due to the physical action required, give rise to intense respiration which would be obstructed by the chin guard.

Figure 1:
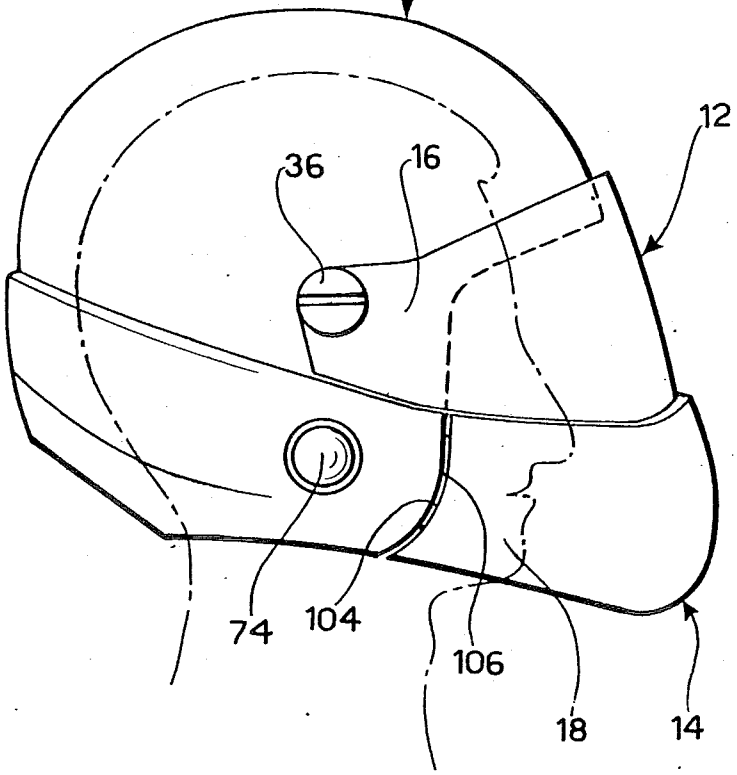
Figure 3:
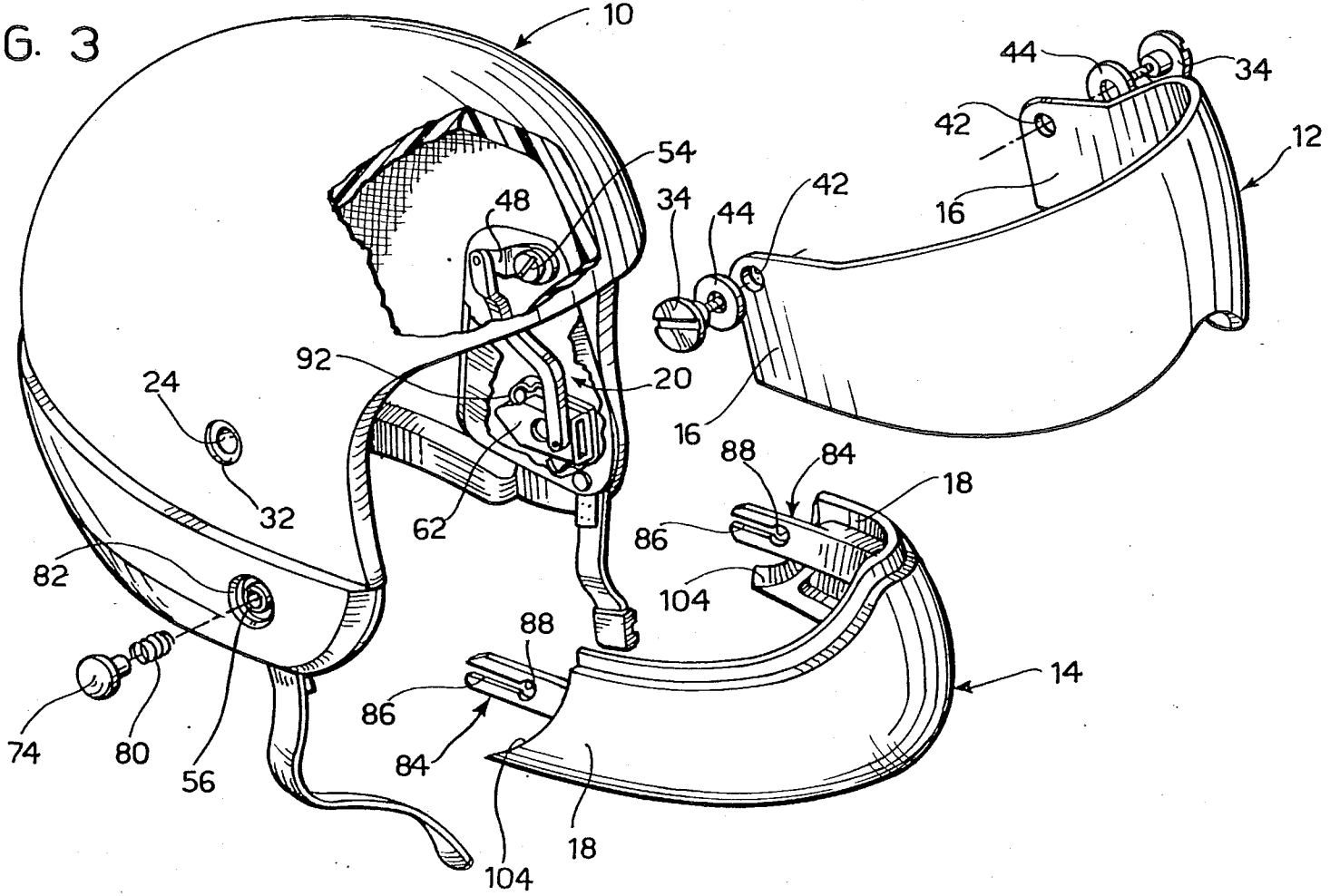
Figure 4:
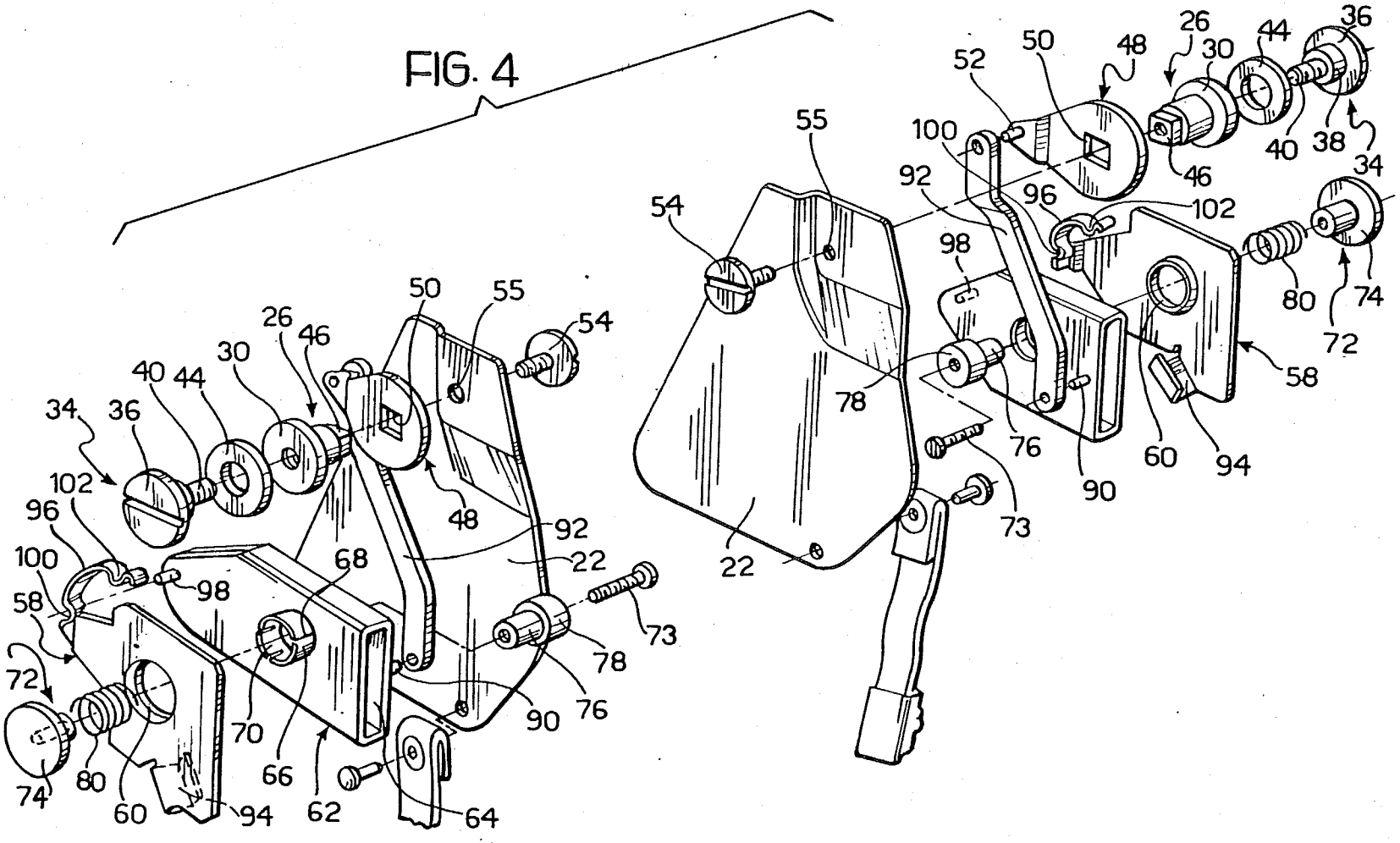
Figure 7:
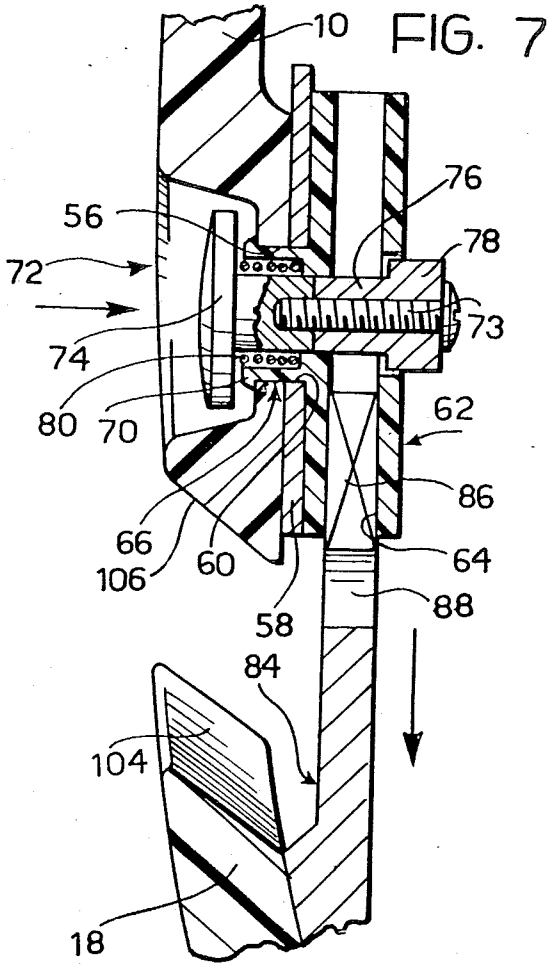
Figure 6:
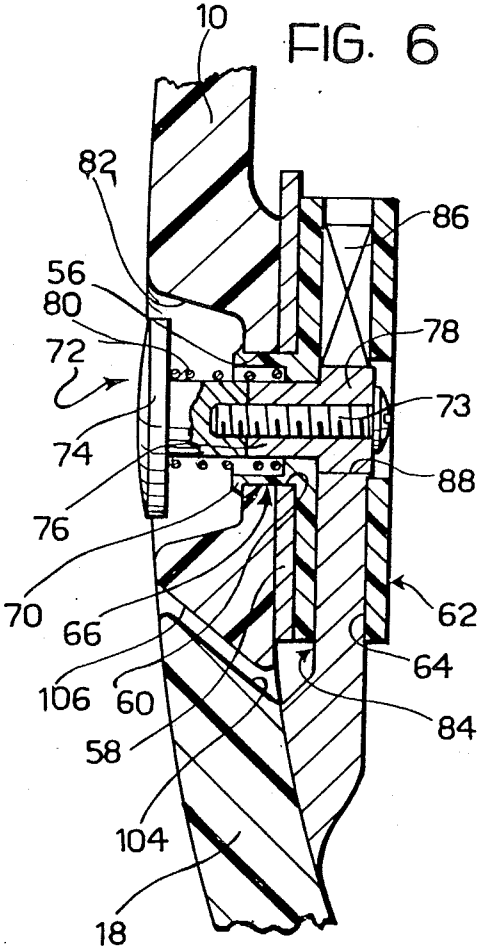
Figure 5:
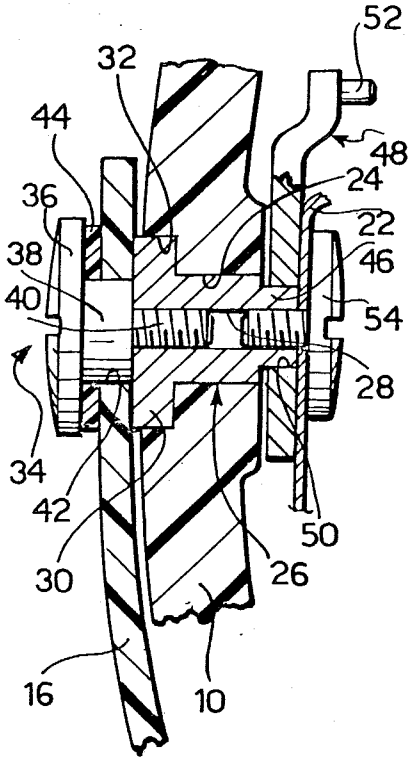
Figure 8:
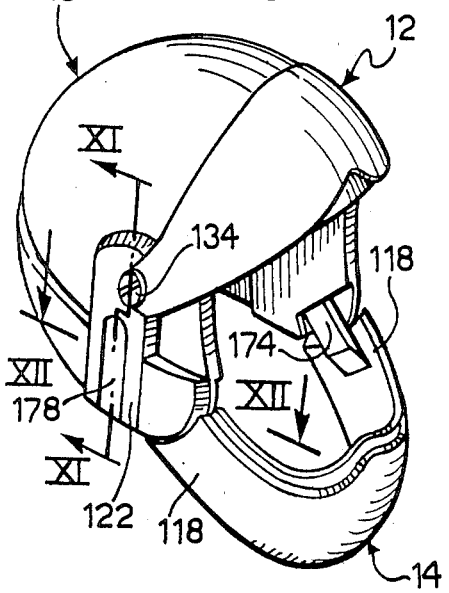
Figure 9:
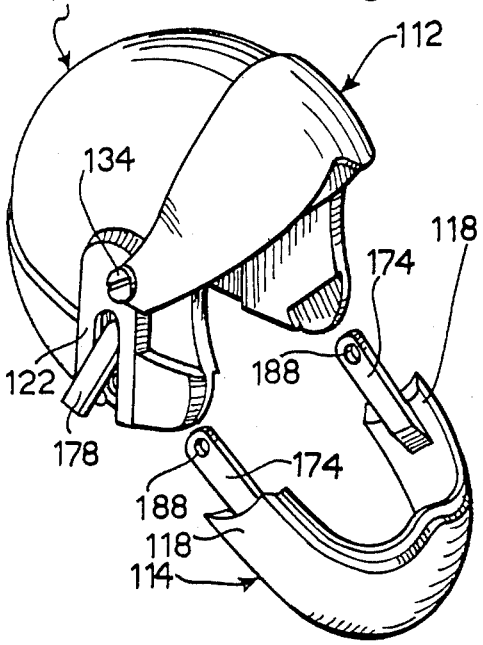
Figure 12:
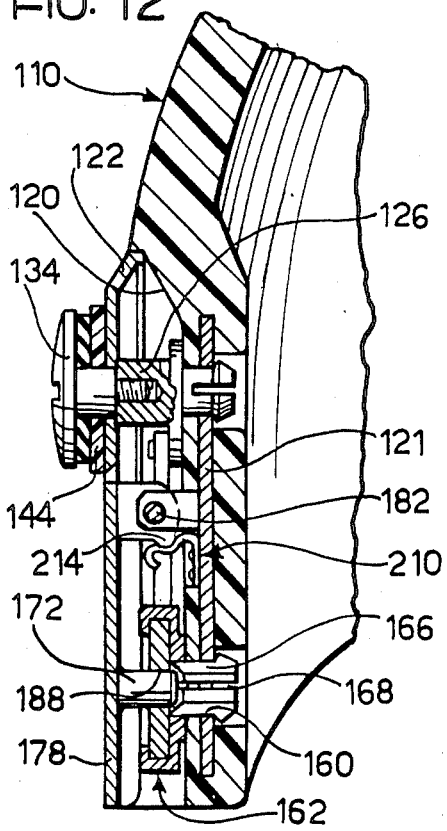
Figure 13:
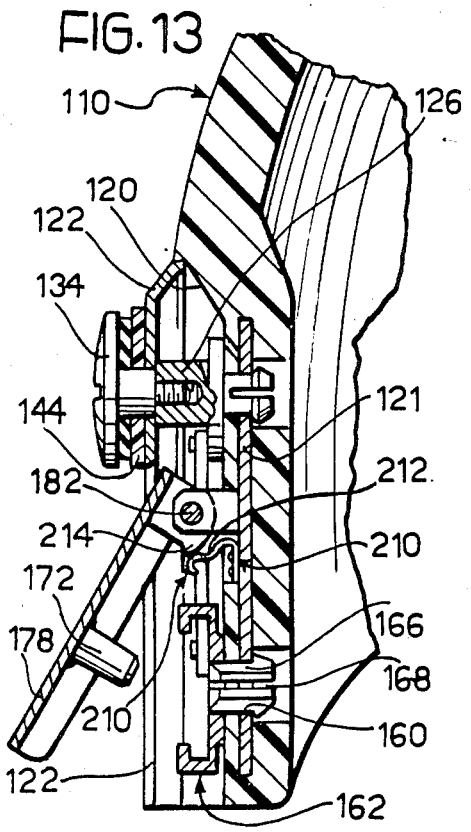
Figure 11:
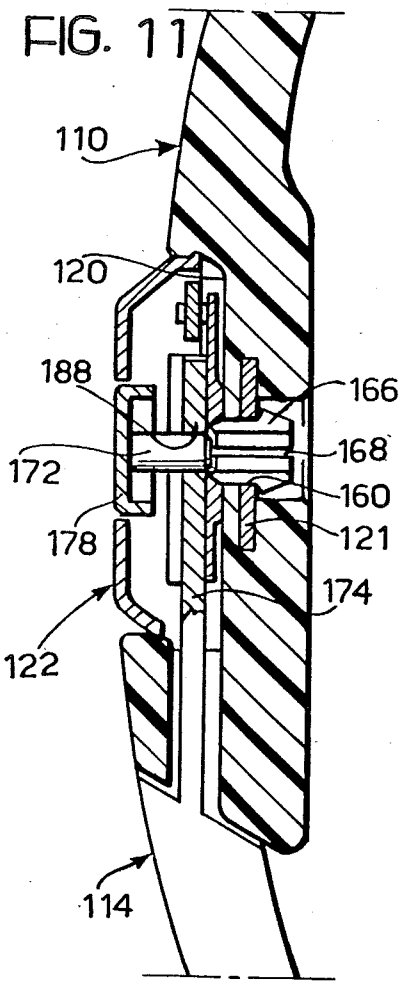
Figure 10:
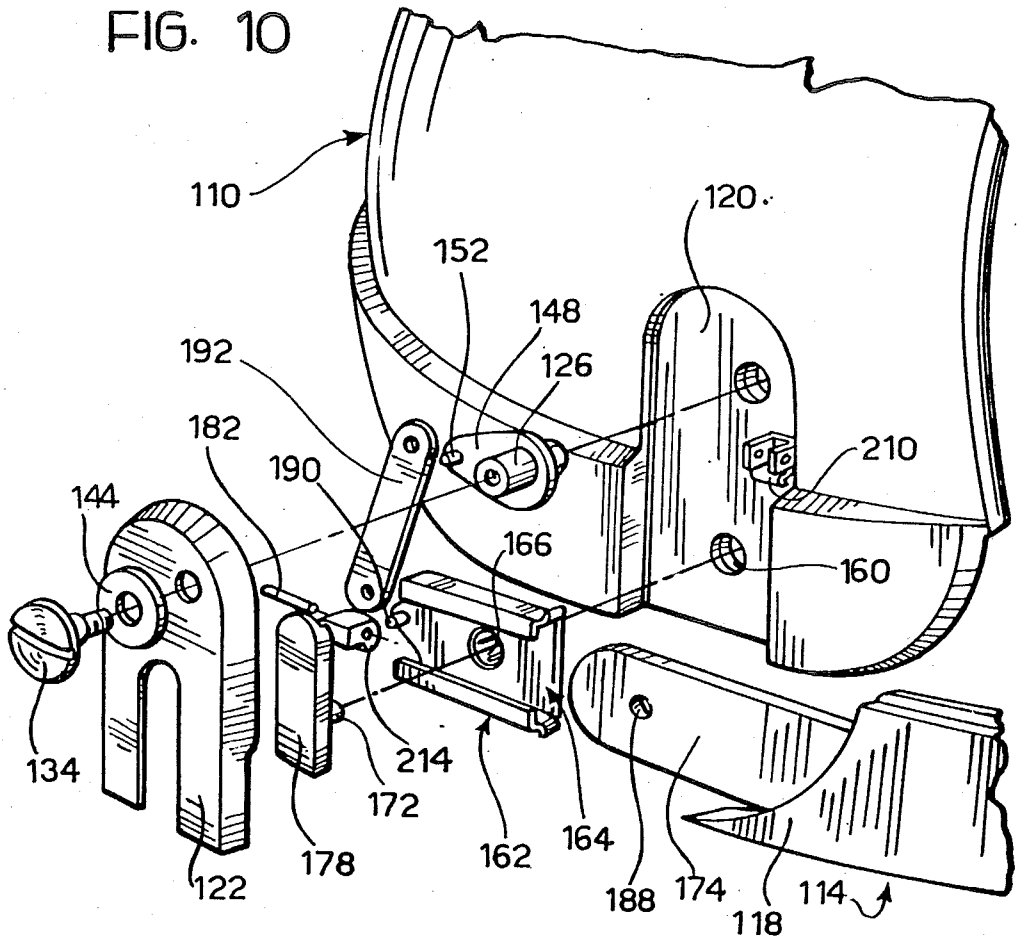

Further characteristics and advantages of the invention will become apparent from a reading of the detail description which follows, made with reference to the appended drawings, given purely by way of non-limiting example, in which:

FIG. 1 is a side view of a headgear according to the invention with the visor lowered and the chin guard raised, FIG. 2 is a corresponding side view with the visor raised and the chin guard lowered, FIG. 3 is an exploded perspective view of the headgear, FIG. 4 is an exploded perspective view, on an enlarged scale, of the hinge means for the visor and the chin guard and of the operating means interconnecting them, FIG. 5 is a section of a detail of the hinge means for the visor on an enlarged scale, FIG. 6 is a section of a similar detail of the hinge means of the chin guard in an engaged condition, FIG. 7 is a section corresponding to FIG. 6 of the same hinge means in a disengaged condition, FIGS. 8 and 9 are perspective views of other headgear according to the invention with the chin guard coupled and with the chin guard detached respectively, FIG. 10 is a partial exploded perspective view of the headgear of FIGS. 8 and 9, FIG. 11 is a partial vertical section, on an enlarged scale, taken on the line XI-XI of FIG. 8, with the chin guard locked, FIG. 12 is a partial horizontal section, on an enlarged scale, taken on the line XII-XII of FIG. 8, with the chin guard locked and, FIG. 13 is a section similar to FIG. 11 with the chin guard unlocked.

With reference to FIGS. 1 to 3, headgear for motorcycling or like activities comprises a protective headgear 10 having an essentially traditional structure. The helmet 10 has a visor 12 and a chin guard 14.

The visor 12, as may best be seen from FIG. 3, is constituted by a piece of transparent plastics material shaped in a wrap-around form, that is in a form which is substantially C-shaped in plan. The lateral arms defined by this C-shape are indicated 16.

The chin guard 14 comprises essentially an element of rigid material similar to that of the helmet 10 with a substantial C-shape in plan so as to have lateral arms 18.

Both the visor 12 and the chin guard 14 are hinged by means of their respective arms 16 and 18 to the sides of the helmet 10 as is clearly seen from FIGS. 1 and 2. This allows the visor 12 to be moved between a lowered position in front of the upper part of the face (FIG. 1) and a raised position on the forehead (FIG. 2) and the chin guard 14 to be moved between a raised position in front of the lower part of the face (FIG. 1) and a lowered position beneath the chin (FIG. 2).

Two symmetrical recesses are formed in the sides of the helmet 10 from the interior, one of these being visible in FIG. 3 where it is indicated 20. Each of these recesses is closed by respective shaped plate 22 (FIG. 4).

The recesses 20 constitute housings for operating means which, as will be seen, interconnect the respective hinge means described below of the arms 16 of the visor 12 and the arms 18 of the chin guard 14.

First of all the hinge means for the visor 12 will be described with reference to FIGS. 3 to 5.

Hinge apertures 24, only one of which is visible in FIG. 3, are formed in the sides of the helmet 10. The apertures 24 put the exterior of the helmet in communication with the interior of the respective recesses 20. A respective pin 26 is rotatably mounted in each aperture 24 and has a threaded axial hole 28. On the exterior of the helmet 10 the pin 26 has a flat flange 30 housed in a corresponding widening 32 of the aperture 24 and projecting slightly from the outer surface of the helmet.

The pin 26 has an associated screw 34 which comprises in succession, from the outside to the inside of the helmet, a head 36, a cylindrical stem 38 and a threaded shank 40.

The corresponding arm 16 of the visor 12 includes a substantially flat apertured end part, the aperture of which is indicated 42. A friction washer 44, for example of rubber, is disposed on the cylindrical stem 38 against the head 36.

As may be seen from FIG. 5, the apertured end part of the arm 16 is gripped together with the friction washer 44 between the flange 30 and the counter-flange constituted by the head 36 of the screw 34, the shank 40 of which is screwed into the aperture 28.

By virtue of the hinge means described above, the arms 16 of the visor 12 are fixed to the pins 26 so as to be rotatable together therewith for the purpose which will be clarified below, but it is possible to raise and lower the visor 12 with the pins 26 stationary if a force is exerted such as to overcome the friction of the washers 44.

The heads 36 of the screws 34 have to advantage a notch such as to allow them to be screwed and unscrewed with the aid of a coin. This allows the visor 12 to be removed easily, for example for replacement by another one which is colourless or of a different colour.

Each pin 26 has a square or at any rate prismatic spigot 46 within the corresponding recess 20. For the purpose which will be clarified below, each pin 26 has a respective lever 48 associated therewith, the lever having a square or at any rate prismatic hole 50 which engages the spigot 46, and a pin 52. The lever 48 is retained on the spigot 46 by means of a screw 54 screwed into the aperture 28. The screw 54 is rotatably supported in a hole 55 in the plate 22.

With reference now to FIGS. 3, 4, 6 and 7, the hinge means for the chin guard 14 will be described.

Beneath each aperture 24 in the sides of the helmet 10 are a further two opposite holes 56 only one of which is visible in FIG. 3. These holes 56 extend from the exterior of the helmet into the respective recesses 20.

A plate 58 having a positioning function which will be clarified below is fixed to the bottom of each recess 20 in correspondence with each hole 56. The plate 58 has a hole 60 corresponding to the hole 56 in the helmet.

In each recess 20 there is a pivotable member 62 in the form of a prismatic sleeve the open end 64 of which faces forwardly of the helmet. One side of the sleeve 62 is disposed against the plate 58 and has a tubular pin 66 with longitudinal slots 68 and an end lip 70. The pin 66 is snap engaged in the holes 60 and 56.

The tubular pin 66 has slidable coaxially therein a bolt 72 in two pieces joined by an axial screw 73. This bolt 72 comprises in succession, from the outside to the inside of the helmet, a head 74, a smaller section shank 76 and a larger section end portion 78.

A helical compression spring 80 is interposed between the head 74 and the adjacent side of the sleeve 62. The head 74 is housed in an outwardly flared mouth 82 of the hole 56 and acts as a push button.

The bolt 72 normally occupies the position illustrated in FIG. 6 in which the end portion 78 is in the sleeve 62 because of the biassing force of the spring 80. The bolt 72 may be thrust against the force of the spring 80 by pressure on the push button 74 to the position of FIG. 7 in which the smaller-section shank 76 is within the sleeve 62.

The arms 18 of the chin guard 14 extend to end appendages 84 which have transverse profiles corresponding to the interior of the sleeves 62.

When the chin guard 14 is coupled to the helmet 10, the two appendages 84 are fully inserted in the respective sleeves 62.

Each appendage 84 has a longitudinal slot 86 of a width corresponding to the section of the shank 76 of the corresponding bolt 72. This slot 86 extends from the free end of the appendage 84 to an enlarged end portion 88 which has a periphery corresponding to that of the end portion 78 of the bolt 72. When the appendage 84 is fully inserted in the sleeve 62, the widened portion 88 is on the axis of the bolt 72 and the end portion 78 is engaged therein as illustrated in FIG. 6 whereby the appendages 84 cannot be withdrawn from the sleeves 62.

If it is wished to remove the chin guard 14, the two push buttons 74 are pressed as in FIG. 7 so that the smaller shank 76 of each bolt 72 is brought into the cavity of the sleeve 62. The appendages 84 may now be removed from the sleeves 62 since the shank 76 may pass through the slots 86.

The recoupling of the chin guard 14 to the helmet 10 is achieved with the opposite maneouvre.

The operating means interconnecting the visor 12 and the chin guard 14 will now be described with reference to FIGS. 3 and 4.

Each pivotable member or sleeve 62 as well as having the function described above of attaching and hinging the chin guard 14, also acts as a lever. For this purpose each pivotable member 62 has a lever pin 90 on its innermost side. Within each recess 20, the pins of the lever 48 and pivotable sleeve 62 are interconnected by a connecting rod 92. As may be understood from the drawings, the arrangement of the connecting rods 92 is such that the lowering of the chin guard 14 causes the raising of the visor 12 and vice versa. Normally this maneouvre is effected by grasping of the chin guard 14 from the front and its pulling downwardly to uncover the face as in FIG. 2. To "reclose" the headgear, the chin guard 14 is normally thrust upwardly with the consequent relowering of the visor 12.

By virtue of the friction connection of the visor 12, if it is desired to raise it while the chin guard 14 is kept in position, it suffices to hold the latter in its raised position of FIG. 1 and to thrust the visor 12 upwardly so as to overcome the friction of the friction washer 44. Thus the visor 12 may be completely raised to the position of FIG. 2, or moved to an intermediate position. For example, it may be desirable to half open simply the visor, to obtain an air slit between this and the chin guard 14. Also, if desired, the visor may be left down and the chin guard 14 may be lowered by overcoming of the friction of the friction washers 44.

A position marking system associated with the chin guard will now be described with reference to FIG. 4.

Each positioning plate 58 has a bracket 94 in the lower front part. At the end of the lowering movement of the chin guard 14, its appendages 84 bear on the brackets 94 thus preventing the chin guard from descending further onto the neck (and the visor 12 from rising excessively).

The two positioning plates 58 carry spring means in the form of arcuate spring clips 96 on their rear part. Pins 98 slide on these clips 96 and project from the outermost sides of the sleeves 62 at their rear ends. The clips 96 are so shaped as to define two seats 100 and 102 in which the pins 98 are respectively snap engaged when the chin guard 14 is entirely raised and when it is entirely lowered. Both the chin guard 14 and the visor 12 are thus kept firmly in the positions illustrated in FIGS. 1 and 2.

With reference to FIGS. 6 and 7 as well as to FIGS. 1 and 2, the chin guard 14 has a safety system for protecting against frontal collisions. The arms 18 of the chin guard 14 have respective bevels 104 at their rear ends. The sides of the helmet 10 on their front edges in correspondence with the arms 18 have corresponding bevels 106. As may be seen from FIG. 1, when the chin guard 14 is raised the bevels 104 and 106 face each other. Their orientation is such that, if the chin guard 14 is subjected to a horizontal collision force, this force is translated into transverse forces which tend to force the arms apart so that the frontal collision is transmitted to the helmet 10 only to a small extent.

With reference now to FIGS. 8 to 13, other headgear according to the invention will be described.

Parts similar to or the same as those of FIGS. 1 to 7, or having a similar function, are indicated by the same reference numerals increased by 100 and their detailed description will not be repeated except to stress the differences which relate to the hinge and attachment system of the chin guard.

The helmet of the headgear is again indicated 110 and the visor and chin guard are also indicated 112 and 114 respectively. The arms of the chin guard are indicated 118.

Two symmetrical recesses 120 are formed in the sides of the helmet 110 from the exterior instead of from the interior, the right hand one being visible in FIGS. 10 to 13. The bottom of each recess is reinforced by a plate 121 (FIGS. 11 and 13) embedded in the material of the helmet 110.

Each of the recesses 120 is closed by a respective upturned U-shaped plate 122.

The recesses 120 constitute housings for the operating means which interconnect the respective hinge means of the visor 112 and the chin guard 114.

The hinge means of the visor 112 include, as before (FIG. 10) respective pins 126 supported by the plate 121 and by the cover 122, each with an outer screw 134 and a friction washer 144.

Respective levers 148 with lever pins 152 are keyed on the pins 126.

The hinge means of the chin guard 114 comprise a pivotable member or sleeve 162 of squared-C section with its open end 164 facing forwardly of the helmet. One side of the sleeve 162 is applied against the bottom of the recess 120 and has a tubular pin 166 with longitudinal slots 168 which is snap engaged in a hole 160 in the reinforcing plate 121.

The sleeve 162 has an associated bolt 172 formed in a single piece with a lever 178 which acts as an operating member for the bolt 172. The lever 178, as will be seen, serves to lock and unlock the chin guard 14 and in the locked position is inserted (FIG. 8) in the recess in the U-shaped plate 122. The lever 178 is hinged to the reinforcing plate 121 by means of a horizontal pin 182.

When the lever 178 is in the positioning locking the chin guard (FIGS. 11 and 12), the pin 172 is aligned with the pin 166.

The arms 118 of the chin guard 114 are extended into terminal appendages 174 having a transverse profile corresponding to that of the interior of the sleeves 162.

When the chin guard 114 is coupled to the helmet 110, the two appendages 184 are fully inserted in the respective sleeves 162.

Each appendage 184 has a seat in the form of a hole 188. When the appendage 184 is fully inserted in the sleeve 162, the hole 188 is on the axis of the pin 166. In this position the chin guard 114 is locked when the lever 178 is applied against the side of the helmet 110, as in FIGS. 8, 11 and 12, with the pin 172 engaged in the hole 188.

If it is desired to remove the chin guard 114, the lever 178 is raised manually to the outwardly tipped position of FIG. 13 whereby the pin 172 is disengaged from the hole 188 and the appendages 174 may be removed from the sleeves 162.

The chin guard 114 is recoupled to the helmet 110 by the opposite maneouvre.

The operating means which interconnect the visor 112 and the chin guard 114 are similar to those of the headgear of FIGS. 1 to 7. Each pivotable member 162 has a lever pin 190 at its end opposite the open end 164. Within each recess 120, the pins of the lever 148 and pivotable sleeve 162 are interconnected by a connecting rod 192 (FIG. 10). As before, the arrangement of the connecting rods 192 is such that the lowering of the chin guard 114 causes the raising of the visor 112 and vice versa.

The friction connection of the visor 112 enables, as previously, the visor itself to move independently of the chin guard 114.

The headgear of FIGS. 8 to 13 is also provided with a position marking system associated with the chin guard and which, for simplicity, is not illustrated.

Another position marking system is associated with the lever 178. As may be seen in FIGS. 10, 12 and 13, a shaped spring 210 is fixed to the reinforcing plate 121. The spring 210 has a recess or seat 212. The lever 178 has a nose 214 in correspondence with the pin 182, as illustrated in FIG. 12, which snap engages in the recess 212 to retain the lever itself in the position in which the chin guard is locked.

Naturally, the scope of the model extends to models which achieve equal utility by using the same innovative concept. Thus, for example, the operating means for transmitting movements, with an inversion of the sense of rotation, from the chin guard to the visor and vice versa, could be constituted by other mechanisms, such as, for example, pairs of gear wheels or pulley transmissions with belts crossed in a figure of eight.

Also the releasable coupling means for the arms of the chin guard which enable its optional removal, could be made differently from those shown. For example the arms of the chin guard could be provided with shaped spring wire appendages in the form of a fork similar to that of the slot 86 and the widened part 88 but with the arms of the forks resiliently divergeable to snap engage a pin in the widened part in order to retain the chin guard in position.

I claim:

1. Headgear for motorcycling and like activities, comprising a protective helmet, a visor and a chin guard, both said visor and said chin-guard being substantially C-shaped in plan so as to have lateral arms which are fixed to the sides of the helmet by respective hinge means which allow the visor to be moved between a lowered position in front of the upper part of the face and a raised position on the forehead and the chin guard adapted to be moved by the hand of a wearer and independently of the chin between a raised position in front of the lower part of the face and a lowered position beneath the chin, the arms of the visor and of the chin guard being interconnected in correspondence with their respective hinge means by operating means such that the lowering of one of the visor and chin guard causes the concomitant raising of the other and vice versa and means for maintaining the visor and the chin guard in their respective raised and lowered positions.

2. Headgear according to claim 1, wherein the operating means incorporate a friction connection such as to allow the visor and the chin guard to be moved independently.

3. Headgear according to claim 1, wherein the lateral arms of the chin guard are fixed to respective hinge means by releasable coupling means to allow the optional removal of the chin guard itself.

4. Headgear according to claim 1, wherein the operating means include a lever on each side of the helmet, the lever being rotatable with the corresponding lateral arm of the visor and a further lever on each side of the helmet, the further lever being rotatable with the corresponding arm of the chin guard, and a connecting rod which interconnects the two levers so as to transmit movement from one lever to the other in the opposite sense of rotation.

5. Headgear according to claim 4, wherein at least one of the said levers of the chin guard carries a positioning member and the corresponding side of the helmet carries spring means which are shaped so as to define two seats in which the positioning member is snap engageable to define the two raised and lowered positions of the chin guard and the corresponding positions of the visor securely.

6. Headgear according to claim 2, wherein the arms of the visor are friction mounted on respective pins supported by the sides of the helmet.

7. Headgear according to claim 6, wherein each of said respective pins has a flat flange on the exterior of the side of the helmet and an axial threaded hole which opens to the exterior of the helmet, each pin having an associated screw which comprises, in succession, a head constituting a flat counter flange, a cylindrical stem and a threaded shank, there being a friction washer disposed on the cylindrical stem, each arm of the visor having a substantially flat end portion which has a hinge aperture which also surrounds the cylindrical stem of the screw, the said end portion being clamped together with the friction washer between the counter flange and the flange.

8. Headgear according to claim 3, wherein the operating means corresponding to each arm of the chin guard are constituted at their ends by pivotable memebers of sleeve form with open ends which face forwardly of the helmet and to one side of each of which is fixed a pin rotatably supported in the side of the helmet, each arm having an end appendage which has a profile corresponding to that of the interior of the sleeve, whereby the arm can be fixed into the pivotable member and removed therefrom through the open end of the said pivotable member, the said appendage having a seat which, when the appendage is fully inserted in the pivotable member, is aligned with the pin, each pivotable member having an associated bolt which is engageable in the seat when the seat is aligned with the pin to retain the chin guard and is disengagable from the seat to free the chin guard for removal thereof from the pivotable member.

9. Headgear according to claim 8, wherein the pin is tubular and the bolt is slideable axially in the pin and includes, in succession, a head accessible from the outside of the helmet to act as a push button, a smaller section shank and a larger section end portion, of the bolt being biased by a spring to a position in which the end portion is in the interior of the sleeve, the bolt being movable, by pressure on the push button against the biasing force, to a position in which the shank is within the sleeve, the terminal appendage of each arm of the chin guard having a longitudinal slot of a width corresponding to the smaller shank of the bolt and which extends from the free end of the appendage to an enlarged end portion having a periphery corresponding to the larger section end portion of the bolt, the enlarged end portion constituting the said seat, the arrangement being such that, when the chin guard is installed, the appendages are inserted in the pivotable member and the larger section end portion of each bolt is within the enlarged end portion of the longitudinal slot in the corresponding appendage, the chin guard being removable by pressing the push buttons and removing the appendages from the pivotable members, the shank of the bolt moving through the slots.

10. Headgear according to claim 8, wherein each seat is constituted by a hole formed in the end appendage of each arm of the chin guard and each bolt is constituted by a pin carried by a lever, the lever being hinged on the side of the helmet and movable manually between an outwardly tipped position in which the pin is remote from the sleeve to free the chin guard and a position applied against the side of the helmet in which the pin is engaged in the hole of the appendage to retain the chin guard.

11. Headgear according to claim 10, wherein each said lever has an associated position marking system which comprises a nose on each said lever and a shaped spring which a recess, the said nose being located in the said recess when the lever is applied against the side of the helmet.

12. Headgear according to claim 6, wherein the operating means include, on each side of the helmet, a lever which is rotatable with the corresponding arm of the visor and a further lever which is rotatable with the corresponding arm of the chin guard, and a connecting rod interconnecting the two levers so as to transmit the movement from one lever to the other, with the opposite sense of rotation, the levers associated with the visor being keyed to friction pins of the visor itself.

13. Headgear according to claim 12, wherein each pin has a prismatic spigot and the respective lever has a prismatic hole in which the spigot is engaged and retained by means of a screw screwed into the said pin.

14. Headgear according to claim 8, wherein operating means include, on each side of the helmet, a lever rotatable with the corresponding arm of the visor and a further lever rotatable with the corresponding arm of the chin guard and a connecting rod interconnecting the two levers so as to transmit movement from one lever to the other, with the opposite sense of rotation, the levers associated with the chin guard being constituted by the said sleeves.

15. Headgear according to claim 1, wherein the arms of the chin guard and the sides of the helmet have cooperating, facing cam surfaces such that a frontal collision force on the chin guard is converted into a couple for rotating the chin guard so as to lower the said chin guard.

* * * * *